US011937709B2

(12) United States Patent
Xu

(10) Patent No.: US 11,937,709 B2
(45) Date of Patent: Mar. 26, 2024

(54) FOLDING FRAME AND OUTDOOR TABLE OR OUTDOOR CHAIR USING THE FOLDING FRAME

(71) Applicant: Dahai Xu, Dongguan (CN)

(72) Inventor: Dahai Xu, Dongguan (CN)

( * ) Notice: Subject to any disclaimer, the term of this patent is extended or adjusted under 35 U.S.C. 154(b) by 0 days.

(21) Appl. No.: 17/694,580

(22) Filed: Mar. 14, 2022

(65) Prior Publication Data

US 2023/0172358 A1 Jun. 8, 2023

(30) Foreign Application Priority Data

Dec. 6, 2021 (CN) ..... 202111472131.6

(51) Int. Cl.

| | |
|---|---|
| ***A47C 4/28*** | (2006.01) |
| ***A47B 3/00*** | (2006.01) |
| ***A47B 37/04*** | (2006.01) |
| ***A47C 1/14*** | (2006.01) |
| ***A47C 4/04*** | (2006.01) |
| ***A47C 4/30*** | (2006.01) |
| ***A47C 4/32*** | (2006.01) |
| ***A47C 4/34*** | (2006.01) |
| ***A47C 4/42*** | (2006.01) |
| ***A47C 4/44*** | (2006.01) |

(52) U.S. Cl.

CPC ..... *A47C 4/04* (2013.01); *A47B 3/002* (2013.01); *A47B 37/04* (2013.01); *A47C 1/14* (2013.01)

(58) Field of Classification Search

CPC ..... A47C 4/28; A47C 4/286

See application file for complete search history.

(56) References Cited

U.S. PATENT DOCUMENTS

| | | | | |
|---|---|---|---|---|
| 9,854,914 | B2 * | 1/2018 | Yoo | A47C 4/286 |
| 10,010,179 | B1 * | 7/2018 | Stump | A47C 4/44 |
| 11,439,238 | B1 * | 9/2022 | Wang | A47C 4/286 |
| 11,700,943 | B1 * | 7/2023 | Wang | A47C 4/286 297/16.2 |
| 2022/0386779 | A1 * | 12/2022 | Garcia | A47C 1/025 |
| 2023/0023969 | A1 * | 1/2023 | Zhu | A47C 4/286 |
| 2023/0172358 | A1 * | 6/2023 | Xu | A47C 9/105 297/16.2 |
| 2023/0200539 | A1 * | 6/2023 | Chen | A47C 3/18 297/47 |

* cited by examiner

*Primary Examiner* — Rodney B White

(57) ABSTRACT

A folding frame and an outdoor table or outdoor chair using the folding frame. The folding frame comprises a base, a plurality of support legs, and a plurality of extension support bars. Both sides on the upper end of the support leg are configured with a teeth part, and every two neighboring support legs are connected through meshing teeth. The base is configured with a locking module to lock the support legs when they are relatively unfolded. The locking module includes a pull rod seat, a spring sheathing the pull rod seat, a plurality of locking blocks, and the pull rod seat is pushed upward under the elastic force of the spring so that the locking block is pushed into the lock slots of the support legs. Thus, the support legs unfolded in relation to the base can be fixed and supported.

18 Claims, 7 Drawing Sheets

FOLDING FRAME AND OUTDOOR TABLE OR OUTDOOR CHAIR USING THE FOLDING FRAME

BACKGROUND OF INVENTION

1. Field of the Invention

The present invention relates generally to the technical field of outdoor products, and more particularly to a folding frame and an outdoor table and outdoor chair using the folding frame.

2. Description of Related Art

Nowadays, along with economic development, urban people are having more outdoor activities to satisfy their spiritual demands and to relax themselves from the stressful working environment. When traveling out for fishing, camping, or gathering, people usually carry portable folding outdoor tables or outdoor chairs.

However, the outdoor tables and outdoor chairs in the current market are simple and the overall structure is not strong enough. Moreover, they have limited folding capability and are inconvenient to use.

In view of this, the following technical solution is proposed.

SUMMARY OF THE INVENTION

The purpose of the present invention is to overcome the deficiencies of the prior art, and to provide a folding frame and an outdoor table and outdoor chair using the folding frame.

In order to solve the above-mentioned technical problems, the present invention adopts the following first technical scheme:

A folding frame, comprising a base, a plurality of support legs hinged around the base, and a plurality of extension support bars hinged on the support legs and capable of folding in relation to the support leg, wherein an upper end of the support leg is configured with teeth on both sides, every two neighboring support legs are connected through meshing teeth to move together, a locking module is configured inside the base to fix the locking module after the support legs are unfolded, the locking module includes a pull rod seat mounted inside the base and capable of moving up and down, a spring sheathed outside the pull rod seat and abutting the base, a plurality of locking blocks hinged inside the base and flexibly connected to the upper end of the pull rod seat, the pull rod seat is pushed upward under the elastic force of the spring, so as to force the locking block into the lock slot on the upper end of the support leg, and to provide fixation support to the support legs unfolded in relation to the base, a lower end of the pull rod seat is extended out of the lower end face of the base, by pulling the pull rod seat downward, the end portion of the locking block will leave the lock slot on the upper end of the support leg to release the locking.

More particularly, wherein a round convex column is formed on either side of the locking block, the locking block is hinged on the base through the round convex column and can swing up and down inside the base.

More particularly, wherein the end portion of the locking block is configured with a hinge slot, and the two sides of the locking block are configured with a slide bar hole that goes through the hinge slot, the outside of the upper end of the pull rod seat is configured with a plurality of hinge portions, the side face of the hinge portions is configured with a through axle hole, the hinge portion mounted inside the hinge slot on the end portion of the locking block, the axle hole of the hinge portion is fitted with a shaft, the end of the shaft goes into the slide bar hole, and can slide inside the slide bar hole.

More particularly, wherein the pull rod seat comprises a seat body, a pull rod screwed on the lower end of the seat body with adjustable height in relation to the seat body, and a pull ring fitted on the lower end of the pull rod, capable of sliding, the spring is sheathed outside the pull ring, the upper end of the spring abuts the lower end face of the seat body, the lower end of the pull rod extends out of the lower end face of the base, the upper end of the pull ring abuts the lower end face of the base.

More particularly, the lower end of the seat body is formed with a threaded column, the upper end of the pull rod is configured with a threaded slot, the threaded column is screwed inside the threaded slot, the section of the seat body is in the shape of a cross, the outside of the seat body has a hinge portion flexibly connected to the locking block.

More particularly, wherein the lower end face of the base is configured with sphere surface slots, the upper end of the pull ring is configured inside the sphere surface slot, and abuts the sphere surface slot.

More particularly, wherein the base comprises a base seat and a cover plate covering the base seat, the base seat is configured with a main mounting slot extending from its upper end face downward to mount the pull rod seat and a plurality of branch mounting slots located outside the main mounting slot, the pull rod seat is fitted inside the main mounting slot, the locking block is hinged inside the branch mounting slots, the outside of the base seat is configured with a plurality of intercommunicating holes communicated to the branch mounting slots, the upper end of the support leg is hinged inside the hole through a pin shaft, the bottom of the main mounting slot is further configured with a sink slot, the spring is fitted inside the sink slot.

More particularly, wherein the number of the support legs is four, each support leg is hinged with an extension support bar, and the support leg has a containing groove to contain the retracted extension support bar.

In order to solve the above-mentioned technical problems, the present invention adopts the following second technical scheme:

a folding frame and a chair cloth fitted on the upper end of the folding frame, the folding frame comprises a base, a plurality of support legs hinged around the base, and a plurality of extension support bars hinged on the support legs, capable of folding in relation to the support legs, the number of the support legs is four, the number of the extension support bars is four, wherein two bars are long extension bars, and the other two bars are short extension support bar, the shape of the chair cloth is in the shape of a hopper, the four corners of the chair cloth are respectively connected to and fixed with the upper ends of the four extension support bars; wherein both sides of the upper end of the support leg are configured with a teeth part, every two neighboring support legs are connected through meshing teeth to move together, a locking module is configured inside the base to fix the locking module after the support legs are unfolded, the locking module comprises a pull rod seat mounted inside the base and capable of moving up and down, a spring sheathed outside the pull rod seat and abutting the base, a plurality of locking blocks hinged inside the base and flexibly connected to the upper end of the pull rod seat, the pull rod seat is pushed upward under the elastic force of the spring, so as to force the locking block into the lock slot on the upper end of the support leg, and to provide fixation support to the support legs unfolded in relation to the base, the lower end of the pull rod seat is extended out of the lower end face of the base, by pulling the pull rod seat downward, the end portion of the locking block will leave the lock slot on the upper end of the support leg to release the locking.

More particularly, wherein both sides of the locking block are formed with a round convex column, and the locking block is hinged with the base through the round convex column, capable of swinging up and down inside the base, the end portion of the locking block is configured with a hinge slot, and the two sides of the locking block are further configured with a slide bar hole going through the hinge slot, the outside of the upper end of the pull rod seat is configured with a plurality of hinge portions, the side face of the hinge portion is configured with a through axle hole, the hinge portion is mounted inside the hinge slot on the end portion of the locking block, the axle hole of the hinge portion is fitted with a shaft, the end of the shaft goes into the slide bar hole, and can slide inside the slide bar hole.

More particularly, wherein the pull rod seat comprises a seat body, a pull rod screwed on the lower end of the seat body with adjustable height in relation to the seat body, and a pull ring fitted on the lower end of the pull rod, capable of sliding, the spring is sheathed outside the pull ring, the upper end of the spring abuts the lower end face of the seat body, the lower end of the pull rod extends out of the lower end face of the base, the upper end of the pull ring abuts the lower end face of the base, the lower end of the seat body is formed with a threaded column, the upper end of the pull rod is configured with a threaded slot, the threaded column is screwed inside the threaded slot, the section of the seat body is in the shape of a cross, the outside of the seat body has a hinge portion flexibly connected to the locking block.

More particularly, wherein the lower end face of the base is configured with sphere surface slots, the upper end of the pull ring is configured inside the sphere surface slot and abuts the sphere surface slot, the support leg has a containing groove to contain the retracted extension support bar.

More particularly, wherein the base comprises a base seat and a cover plate covering the base seat, the base seat is configured with a main mounting slot extending from its upper end face downward to mount the pull rod seat, and a plurality of branch mounting slots located outside the main mounting slot, the pull rod seat is fitted inside the main mounting slot, the locking block is hinged inside the branch mounting slot, the outside of the base seat is configured with a plurality of intercommunicating holes communicated to the branch mounting slots, the upper end of the support leg is hinged inside the hole through a pin shaft, the bottom of the main mounting slot is further configured with a sink slot, the spring is fitted inside the sink slot.

In order to solve the above-mentioned technical problems, the present invention adopts the following third technical scheme:

An outdoor table, which comprises a folding frame and a table cloth configured on the upper end of the folding frame, the folding frame comprises a base, a plurality of support legs hinged around the base, and a plurality of extension support bars hinged on the support legs, capable of folding in relation to the support legs, the number of the support legs is four, the number of the extension support bars is four, with the same length, the four corners of the table cloth are respectively connected to and fixed with the upper ends of the four extension support bars through the connecting blocks; wherein both sides of the upper end of the support leg are configured with a teeth part, every two neighboring support legs are connected through meshing teeth to move together, a locking module is configured inside the base to fix the locking module after the support legs are unfolded, the locking module comprises a pull rod seat mounted inside the base and capable of moving up and down, a spring sheathed outside the pull rod seat and abutting the base, and a plurality of locking blocks hinged inside the base and flexibly connected to the upper end of the pull rod seat, the pull rod seat is pushed upward under the elastic force of the spring, so as to force the locking block into the lock slot on the upper end of the support leg, and to provide fixation support to the support legs unfolded in relation to the base, the lower end of the pull rod seat is extended out of the lower end face of the base, by pulling the pull rod seat downward, the end portion of the locking block will leave the lock slot on the upper end of the support leg to release the locking.

More particularly, wherein both sides of the locking block are formed with a round convex column, and the locking block is hinged with the base through the round convex column, capable of swinging up and down inside the base, the end portion of the locking block is configured with a hinge slot, and the two sides of the locking block are further configured with a slide bar hole going through the hinge slot, the outside of the upper end of the pull rod seat is configured with a plurality of hinge portions, the side face of the hinge portion is configured with a through axle hole, the hinge portion is mounted inside the hinge slot on the end portion of the locking block, the axle hole of the hinge portion is fitted with a shaft, the end of the shaft goes into the slide bar hole, and can slide inside the slide bar hole.

More particularly, wherein the pull rod seat comprises a seat body, a pull rod screwed on the lower end of the seat body with adjustable height in relation to the seat body, and a pull ring fitted on the lower end of the pull rod, capable of sliding, the spring is sheathed outside the pull ring, the upper end of the spring abuts the lower end face of the seat body, the lower end of the pull rod extends out of the lower end face of the base, the upper end of the pull ring abuts the lower end face of the base, the lower end of the seat body is formed with a threaded column, the upper end of the pull rod is configured with a threaded slot, the threaded column is screwed inside the threaded slot, the section of the seat body is in the shape of a cross, the outside of the seat body has a hinge portion flexibly connected to the locking block.

More particularly, wherein the lower end face of the base is configured with sphere surface slots, the upper end of the pull ring is configured inside the sphere surface slot and abuts the sphere surface slot, the support leg has a containing groove to contain the retracted extension support bar.

More particularly, wherein the base comprises a base seat and a cover plate covering the base seat, the base seat is configured with a main mounting slot extending from its upper end face downward to mount the pull rod seat and a plurality of branch mounting slots located outside the main mounting slot, the pull rod seat is fitted inside the main mounting slot, the locking block is hinged inside the branch mounting slot, the outside of the base seat is configured with a plurality of intercommunicating holes communicated to the branch mounting slots, the upper end of the support leg is hinged inside the hole through a pin shaft, the bottom of the main mounting slot is further configured with a sink slot, the spring is fitted inside the sink slot.

Comparing with the prior art, the present invention has the following effects and benefits:

Teeth are configured on both sides of the upper end of the support legs of the folding frame of the present invention, so that every two neighboring support legs can be connected through meshing teeth. Thus, when folding or unfolding one support leg in relation to the base, all the support legs are folded or unfolded simultaneously through the connection realized by the meshing teeth. This greatly facilitates operation. When the support legs are unfolded in relation to the base, the pull rod seat will be pushed upward by the elastic force of the spring, forcing the top end of the locking block into the lock slot on the upper end of the support leg, so that the support leg is stably fixed on the periphery of the base, and the support leg unfolded in relation to the base is stably supported. The lower end of the pull rod seat is extended out of the lower end face of the base. By pulling the pull rod seat downward, the end portion of the locking block will leave the lock slot on the upper end of the support leg, and the locked state is released. At this point, the support leg can be folded in relation to the base. The folding and unfolding of the folding frame are very easy to operate, bringing great convenience to users.

DETAILED DESCRIPTION OF THE INVENTION

Figure 1:
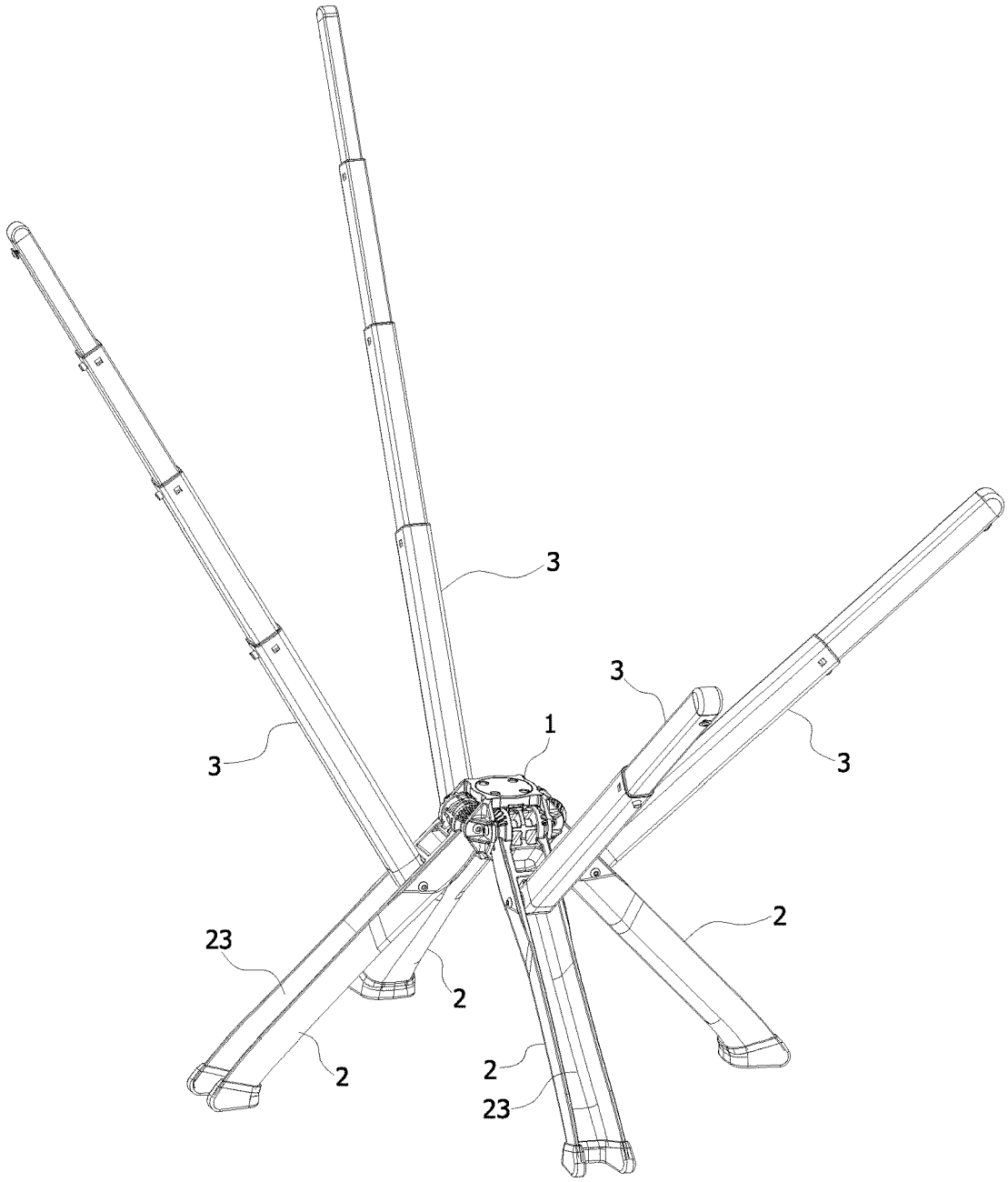
FIG. 1 is a perspective view of the present invention after the folding frame is unfolded.
Figure 2:
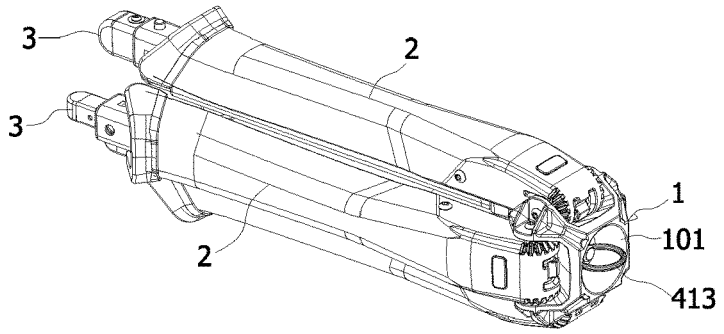
FIG. 2 is a perspective view of the present invention after the folding frame is folded.
Figure 3:
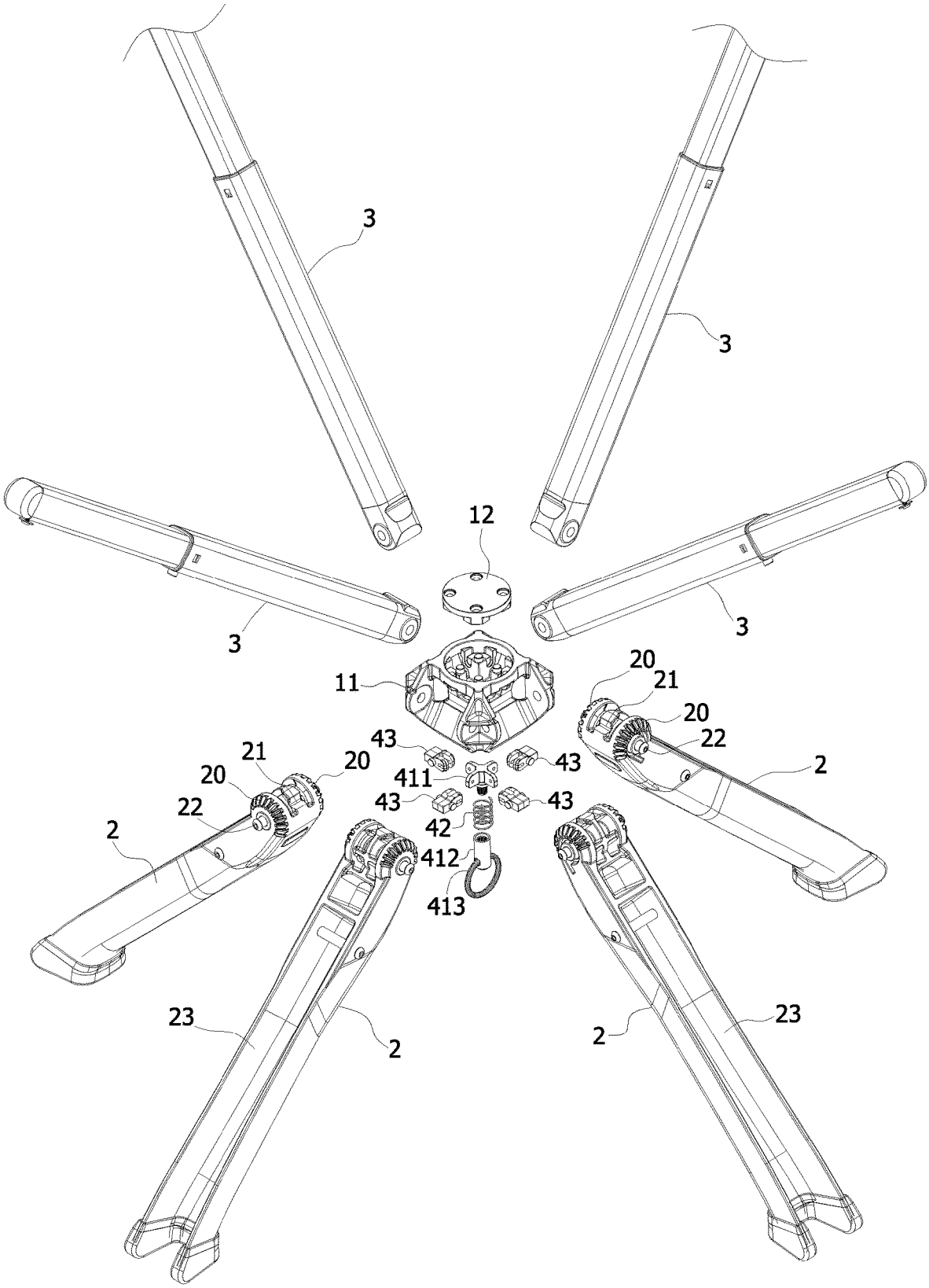
FIG. 3 is an exploded view of the folding frame of the present invention.
Figure 4:
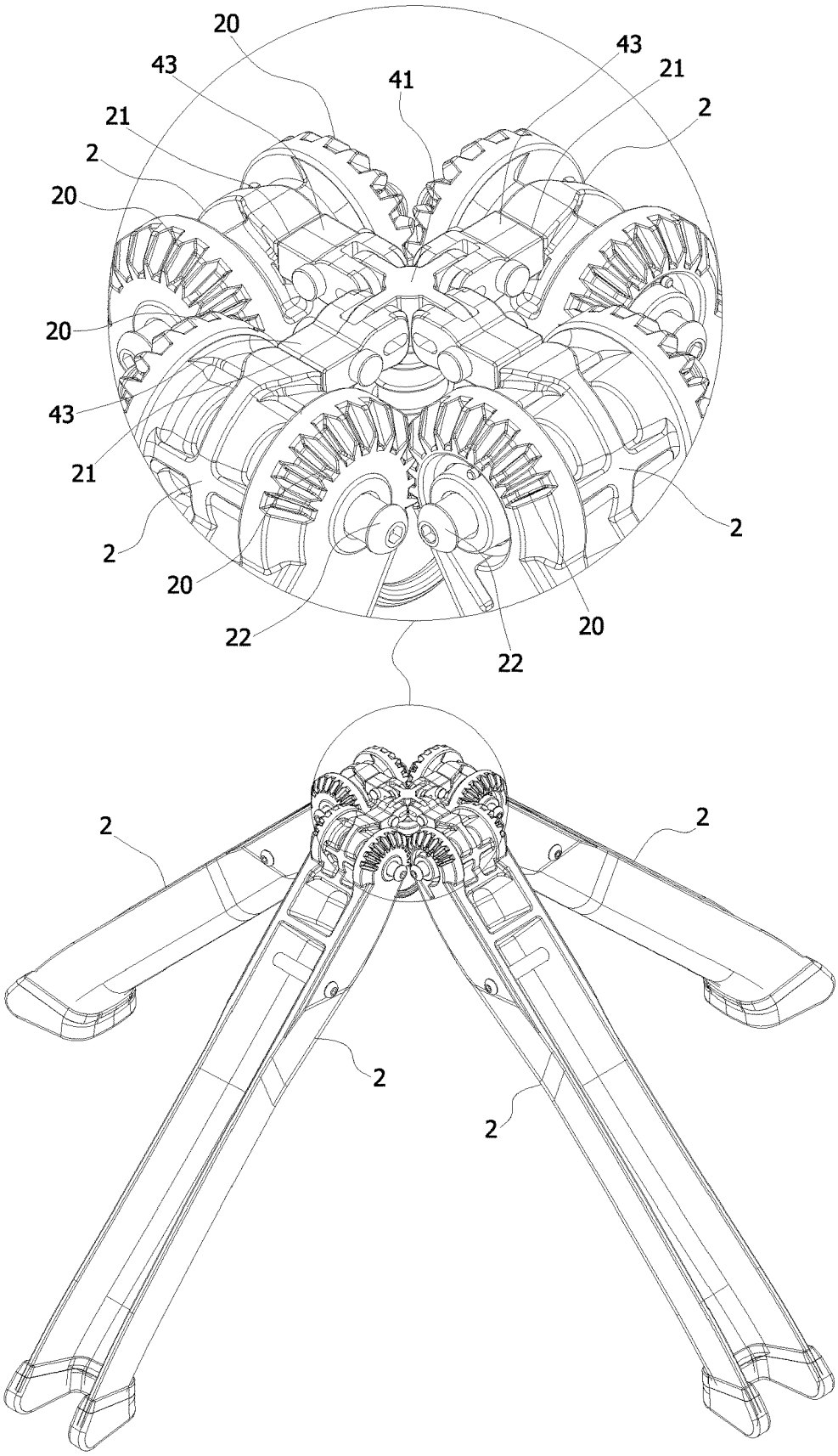
FIG. 4 is a partial structural view of the folding frame of the present invention.
Figure 5:
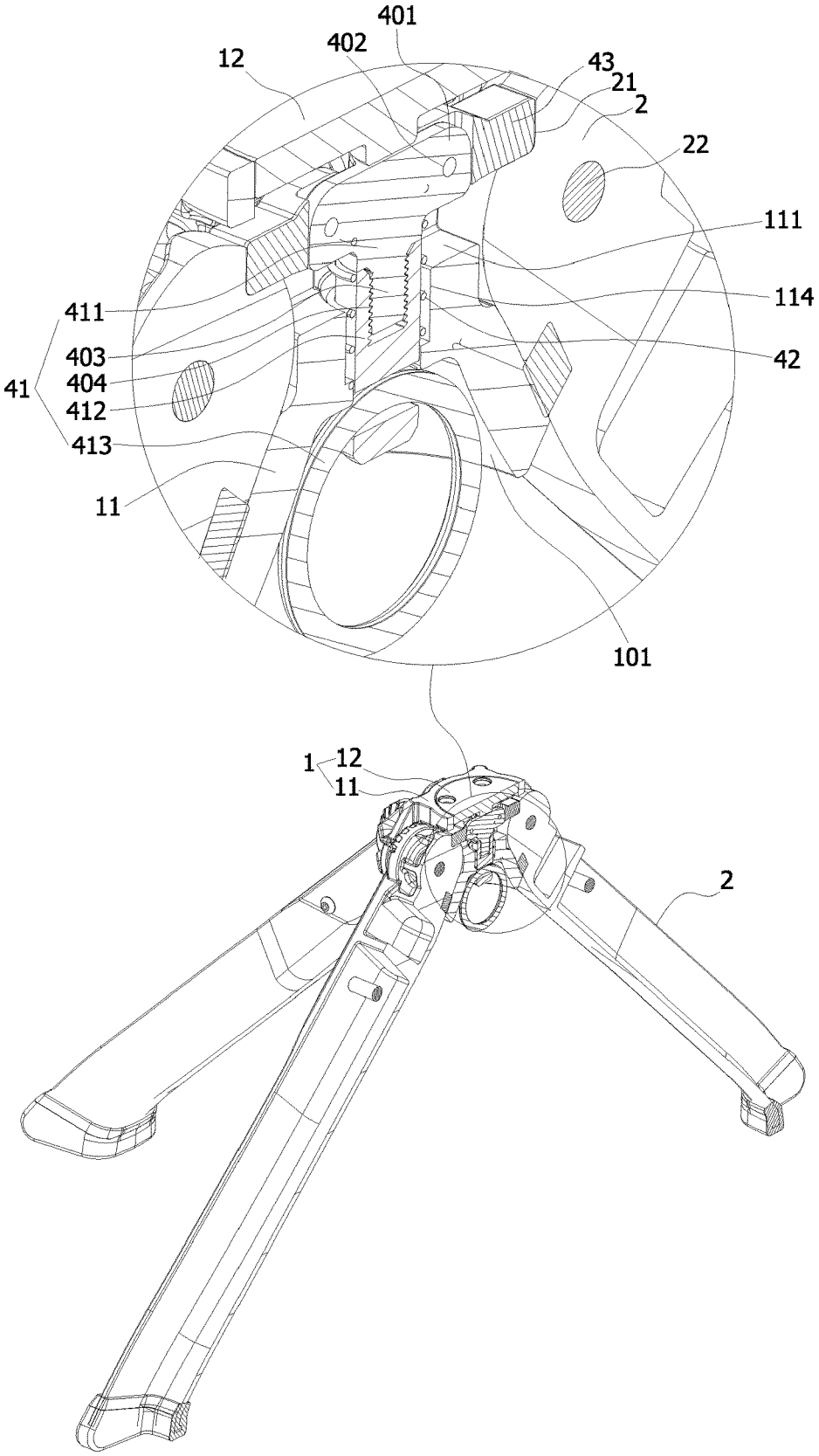
FIG. 5 is a sectional view of the partial structure of the folding frame of the present invention.
Figure 6:
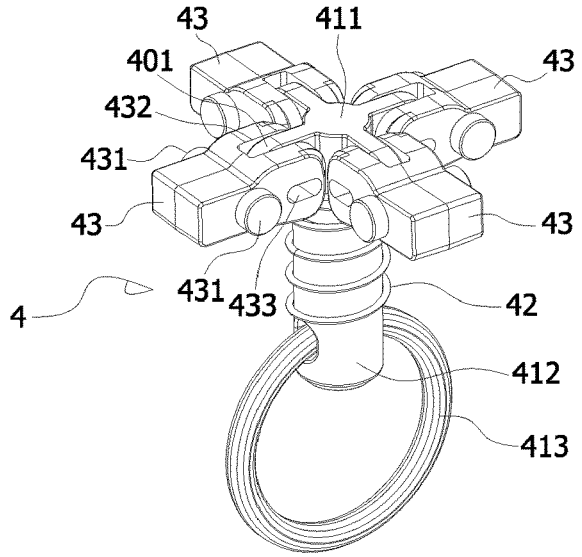
FIG. 6 is a perspective view of the locking module of the present invention.
Figure 7:
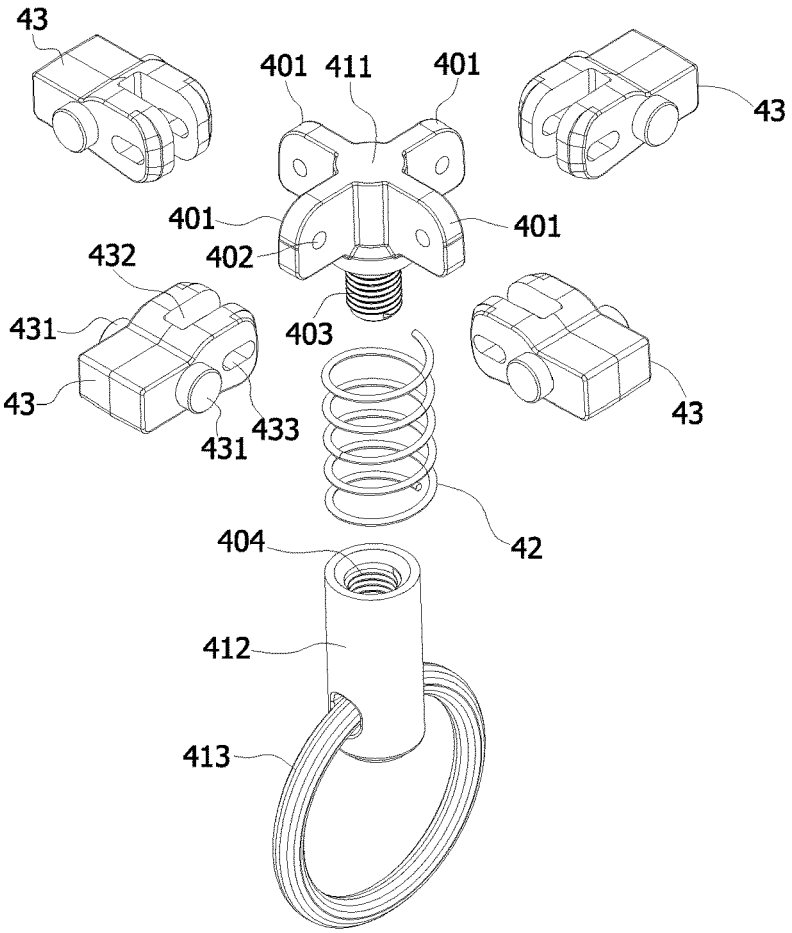
FIG. 7 is an exploded perspective view of the locking module of the present invention.
Figure 8:
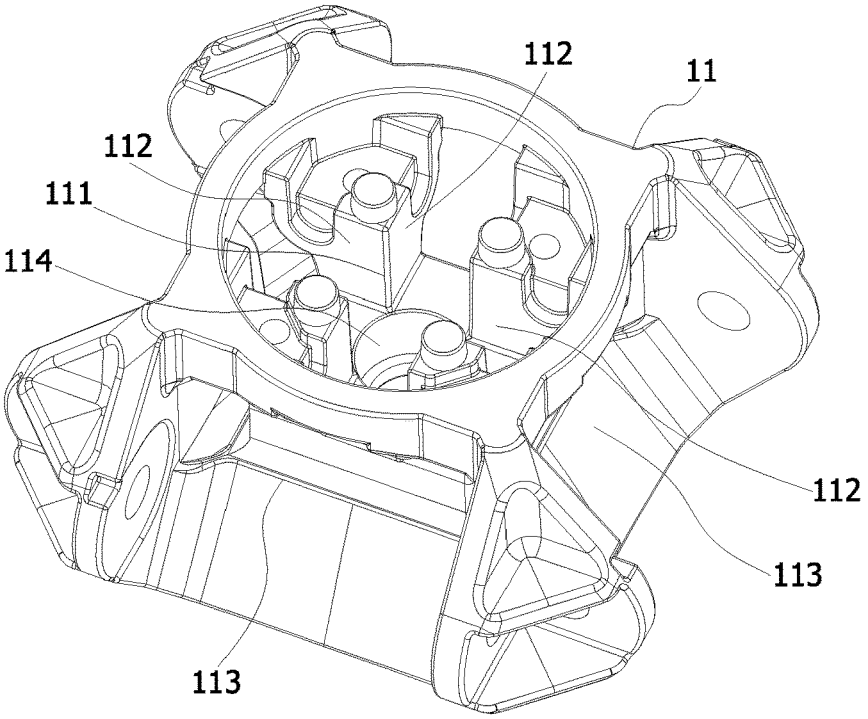
FIG. 8 is a perspective view of the base seat of the present invention.
Figure 9:
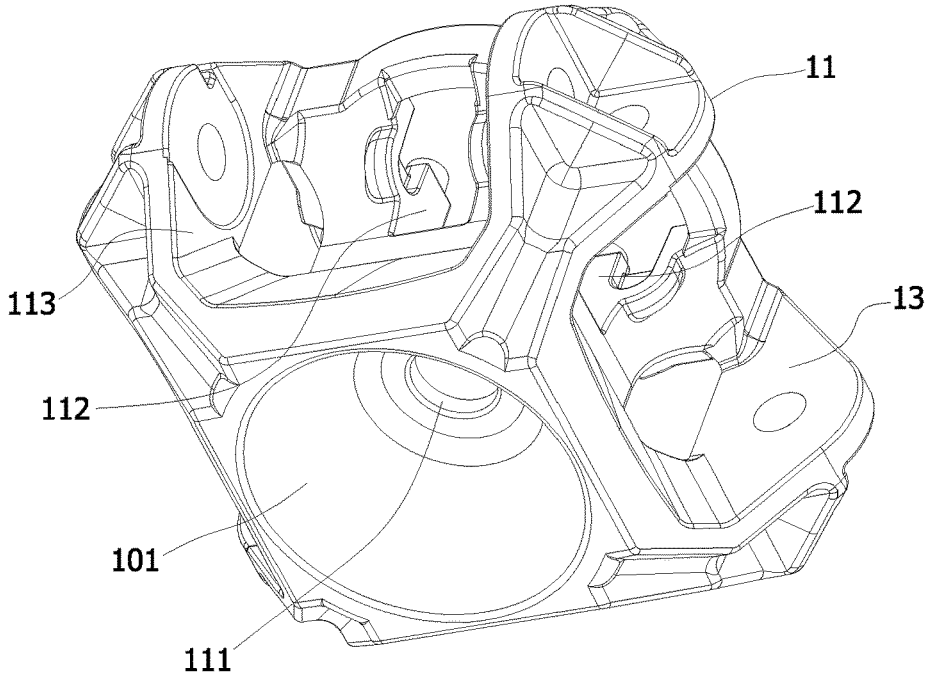
FIG. 9 is another perspective view of the base seat of the present invention.

Depicted in FIGS. 1-9 is a folding frame. The folding frame 100 comprises a base 1, a plurality of support legs 2 hinged around the base 1, a plurality of extension support bars 3 hinged on the support legs 2 and capable of folding in relation to the support leg 2. To use the frame, unfold the support leg 2 in relation to the base 1 to support the base 1, unfold the extension support bars 3 in relation to the support legs 2 and extend them for support. To fold the frame for storage, retract the extension support bars 3 for folding, and fold the extension support bars 3 in relation to the support leg 2. The support legs 2 are folded bottom up in relation to the base 1, so as to reduce the overall size of the folded product for convenient transportation.

Both sides of the upper end of the support leg 2 are configured with teeth 20, every two neighboring support legs 2 are connected through meshing teeth 20, so that, when any one support leg 2 is folded or unfolded in relation to the base 1, all support legs 2 will be folded or unfolded simultaneously through the connection realized by the meshing teeth 20. This design makes operation very convenient.

A locking module 4 is configured inside the base 1 to position the relatively unfolded support legs 2. When the support legs 2 are unfolded in relation to the base 1, the locking module 4 fixes the support leg 2 inside the base 1, to avoid unexpected retraction of the support legs 2 in relation to the base 1 and guarantee safety of use. Meanwhile, the folding frame is stably supported and can provide strong support.

The locking module 4 includes a pull rod seat 41 mounted inside the base 1 and capable of moving up and down, a spring 42 sheathing the outside of the pull rod seat 41 and abutting the base 1, a plurality of locking blocks 43 hinged inside the base 1 and connected to the outside of the upper end of the pull rod seat 41. The pull rod seat 41 is pushed upward under the elastic force of the spring 42, forcing the end portion of the locking block 43 into the lock slot 21 on the upper end of the support leg 2, thus fixing the support legs 2 on the outside of the base 1, and realizing stable support of the support legs 2 unfolded in relation to the base 1. The lower end of the pull rod seat 41 is extended out of the end face of the lower end of the base 1. By pulling the pull rod seat 41 downward, the end portion of the locking block 43 is forced to leave the lock slot 21 on the upper end of the support leg 2, and the locked state is released. At this point, the support leg 2 can be folded in relation to the base 1. The folding and unfolding of the folding frame is very easy to operate, bringing great convenience to users.

The base 1 comprises a base seat 11 and a cover plate 12 covering the base seat 11, wherein, the cover plate 12 is locked with the base seat 11 through a screw.

The base seat 11 is provided with a main mounting slot 111 extending from its upper end face downward for mounting the pull rod seat 41 and a plurality of branch mounting slots 112 located outside the main mounting slot 111. The pull rod seat 41 is held inside the main mounting slot 111, and the lower end of the pull rod seat 41 is extended out of the lower end face of the base seat 11. The locking block 43 is hinged inside the branch mounting slot 112. The outside of the base seat 11 is configured with a plurality of intercommunicating holes 113 and communicated to the branch mounting slot 112. The upper end of the support leg 2 is hinged inside the hole 113 through a pin shaft 22. Because the holes 113 are intercommunicating, and the teeth 20 of every two neighboring support legs 2 can smoothly mesh with each other, the stability of the assembly is guaranteed. The bottom of the main mounting slot 111 is further configured with a sink slot 114. The spring 42 is installed inside the sink slot 114. The upper end of the spring 42 abuts the pull rod seat 41. The lower end of the spring 42 abuts the bottom of the sink slot 114.

The locking block 43 are formed with round convex columns 431 on both sides, and are hinged with the base 1 through the round convex columns 431, capable of moving up and down inside the base 1. Specifically, the round convex column 431 of the locking block 43 is hinged inside the groove configured on the inner wall of the branch mounting slot 112, so that the locking block 43 can swing up and down inside the base 1.

The end portion of the locking block 43 is configured with a hinge slot 432. And the two sides of the locking block 43 is further configured with a slide bar hole 433 going through the hinge slot 432. The outside of the upper end of the pull rod seat 41 is configured with a plurality of hinge portion 401. The side face of the hinge portion 401 is configured with a through axle hole 402. The hinge portion 401 is mounted inside the hinge slot 432 on the end portion of the locking block 43, and is capable of sliding. The axle hole 402 of the hinge portion 401 is fitted with a shaft. The end portion of the shaft goes through the slide bar hole 433 and can slide inside the slide bar hole 433. When the pull rod seat 41 is pushed upward under the elastic force of the spring 42, the hinge portion 401 drives the end portion of the locking block 43 to swing downward through the shaft, forcing the end portion of the locking block 43 into the lock slot 21 of the upper end of the support leg 2, thus realizing the locking function. When the pull rod seat 41 is pulled downward, the hinge portion 401 slides inside the slide bar hole 433 of the locking block 43 through the shaft, driving the end portion of the locking block 43 to swing upward within a sufficient space, so that the end portion of the locking block 43 leaves the lock slot 21 of the upper end of the support leg 2, thus realizing the unlocking function.

The pull rod seat 41 comprises a seat body 411, a pull rod 412 screwed on the lower end of the seat body 411, with its height in relation to the seat body 411 adjustable, and a pull ring 413 configured on the lower end of the pull rod 412 capable of sliding. The spring 42 is sheathed outside the pull ring 413, and the upper end of the spring 42 abuts the lower end face of the seat body 411. The lower end of the pull rod 412 is extended out of the lower end face of the base 1. The upper end of the pull ring 413 abuts the lower end of the base 1. To fold up the folding frame 100, the pull ring 413 can be pulled downward to release the locking, which is very convenient.

In particular, as the height of the pull rod 412 in relation to the seat body 411 is adjustable, and the upper end of the spring 42 abuts the lower end face of the seat body 411, by adjusting the height of the pull rod 412 in relation to the seat body 411, the compression degree of the spring 42 can be adjusted to control the elastic force of the spring 42, and to guarantee the stability of the locking state between the locking block 43 and the lock slot 21.

The lower end of the seat body 411 is formed with a threaded column 403. The upper end of the pull rod 412 is configured with a threaded slot 404. The threaded column 403 is screwed inside the threaded slot 404. The assembly structure is simple. By twisting the pull ring 413, the pull rod 412 can be driven to rotate, so that the depth of the threaded column 403 into the threaded slot 404 can be adjusted to adjust the height of the pull rod 412 in relation to the seat body 411.

The section of the seat body 411 is in the shape of a cross, and the outside of the seat body 411 has a hinge portion 401 flexibly connected to the locking, block 43.

The lower end of the base 1 is configured with sphere surface slots 101. The upper end of the pull ring 413 is configured inside the sphere surface slot 101, and abuts the sphere surface slot 101.

The number of the support legs 2 is four. Each support leg 2 is hinged with an extension support bar 3. The support leg 2 has a containing groove 23 to contain the retracted extension support bar 3.

In summary, the upper end of the support leg 2 of the folding frame is configured with teeth 20 on both sides. Every two neighboring support legs 2 are connected by the meshing teeth 20 to move together. Thus, when one support leg 2 is folded or unfolded in relation to the base 1, all support legs 2 will be folded or unfolded simultaneously through the connection realized by the meshing teeth 20. This design for simultaneous folding is very convenient for use. When the support legs 2 are unfolded in relation to the base 1, the pull rod seat 41 is pushed upward under the elastic force of the spring 42, forcing the end portion of the locking block 43 into the lock slot 21 of the upper end of the support leg 2, thus ensuring stable position of the support legs 2 outside the base 1, and providing support to the support legs 2 unfolded in relation to the base 1. The lower end of the pull rod seat 41 is extended out of the end face of the lower end of the base 1. By pulling the pull rod seat 41 downward to force the end portion of the locking block 43 to leave the lock slot 21 on the upper end of the support leg 2, the locked state can be released. At this point, the support legs 2 can be folded in relation to the base 1. The folding and unfolding of the folding frame is very easy to operate, bringing great convenience to users.

Figure 10:
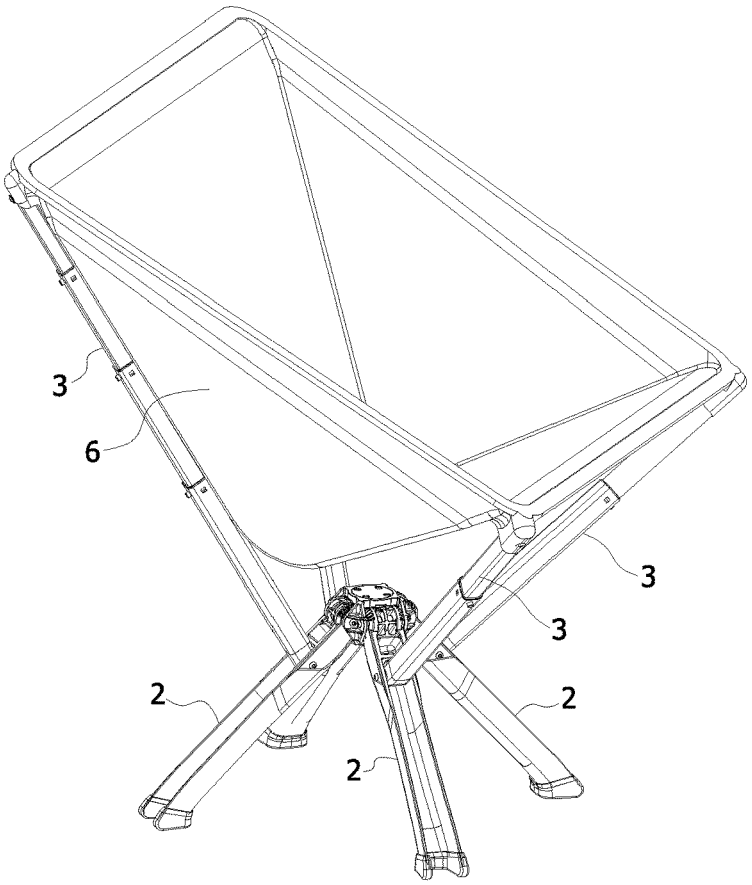
FIG. 10 is a perspective view of the outdoor chair according to the present invention.

Depicted in FIG. 10 is an outdoor chair, which comprises the aforethe folding frame 100 and a chair cloth 6 configured on the upper end of the folding frame 100. The number of the support legs 2 is four. The number of the extension support bars 3 is four, wherein two bars are long extension bars, and the other two bars are short extension support bars. The chair cloth 6 is in the shape of a hopper, and the four corners of the chair cloth 6 are respectively connected to and fixed with the upper ends of the four extension support bars 3.

As the structure of the folding frame 100 used by the outdoor chair has been clearly described above, it is not repeated herein. The outdoor chair features a simple structure and can be quickly and conveniently folded through the folding frame 100. The size after folding is small and is suitable for transportation.

Figure 11:
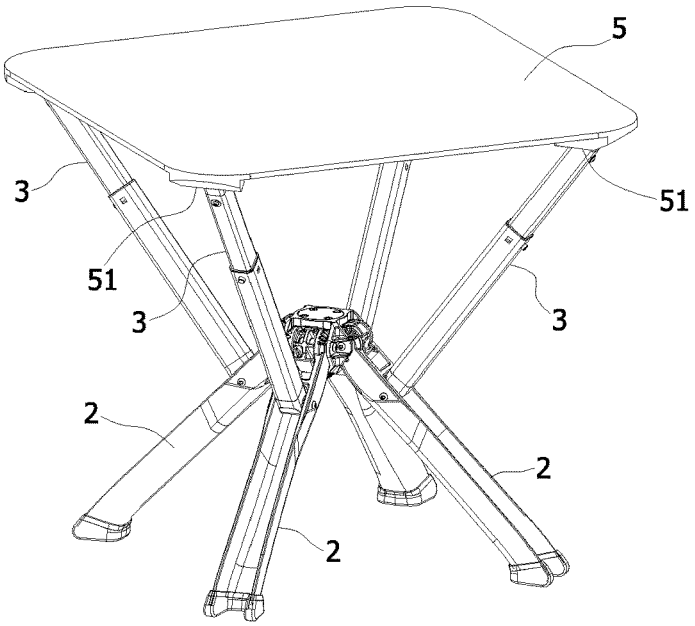
FIG. 11 is a perspective view of the outdoor table according to the present invention.

Depicted in FIG. 11 is an outdoor table, which comprises the aforethe folding frame 100 and a table cloth 5 configured on the upper end of the folding frame 100. The number of the support legs 2 is four. The number of extension support bars 3 is four. They have the same length. The four corners of the table cloth 5 are respectively connected to and fixed with the upper ends of the four extension support bars 3 through connecting blocks 51.

As the structure of the folding frame 100 used by the outdoor table has been clearly described above, it is not repeated herein. The outdoor table features a simple structure and can be quickly and conveniently folded through the folding frame. The size after folding is small and is suitable for transportation.

I claim:

1. A folding frame, comprising a base, a plurality of support legs hinged around the base, and a plurality of extendable support rods hinged on the support legs and capable of folding in relation to the support leg, wherein an upper end of the support leg is configured with teeth on both sides, every two neighboring support legs are connected through meshing teeth to move together, a locking module is configured inside the base to fix the locking module after the support legs are unfolded, the locking module includes a pull rod seat mounted inside the base and capable of moving up and down, a spring sheathed outside the pull rod seat and abutting the base, a plurality of locking blocks hinged inside the base and flexibly connected to an upper end of the pull rod seat, the pull rod seat is pushed upward under the elastic force of the spring, so as to force the plurality of locking blocks into a locking groove on the upper end of the support leg, and to provide fixation support to the support legs unfolded in relation to the base, a lower end of the pull rod seat is extended out of a lower end face of the base, by pulling the pull rod seat downward, an end portion of the locking block will leave the locking groove on the upper end of the support leg to release the locking.

2. The folding frame defined in claim 1, wherein each of the plurality of lock blocks has a circular protrusion formed on both sides, which is pivotally connected to the base through the circular protrusion, and can swing up and down within the base.

3. The folding frame defined in claim 2, wherein one end of the plurality of locking blocks is configured with a hinged groove, and the two sides of the locking block are configured with a bar-shaped sliding hole that goes through the hinged groove, an outside of the upper end of the pull rod seat is configured with a plurality of hinge portions, a side face of the hinge portions is configured with a through axle hole, the hinge portion mounted in the hinged groove of each of the plurality of locking blocks, the axle hole of the hinge portion is fitted with a shaft, one end of the shaft goes into the bar-shaped sliding hole, and can slide inside the bar-shaped sliding hole.

4. The folding frame defined in claim 1, wherein the pull rod seat comprises a seat body, a pull rod screwed on a lower end of the seat body with adjustable height in relation to the seat body, and a pull ring fitted on the lower end of the pull rod, capable of sliding, the spring is sheathed outside the pull ring, the upper end of the spring abuts the lower end face of the seat body, the lower end of the pull rod extends out of the lower end face of the base, an upper end of the pull ring abuts the lower end face of the base.

5. The folding frame defined in claim 4, wherein the number of support legs is four, each support leg is hinged with the extendable support rod, and has a storage slot for the retracted extendable support rod.

6. The folding frame defined in claim 4, the lower end of the seat body is formed with a threaded column, an upper end of the pull rod is configured with a threaded slot, the threaded column is screwed inside the threaded slot, a section of the seat body is in the shape of a cross, an outside of the seat body has a hinge portion flexibly connected to the plurality of locking blocks.

7. The folding frame defined in claim 4, wherein a lower end face of the base is configured as a spherical groove, the upper end of the pull ring is disposed in the spherical groove and abuts against the spherical groove.

8. The folding frame defined in claim 1, wherein the base includes a base seat and a cover plate covering the base seat, an upper surface of the base seat extends downward to provide a main mounting groove for installing the pull rod seat and a plurality of sub-mounting grooves located outside of the main mounting groove, the pull rod seat is threaded through the main mounting groove, the plurality of locking blocks are hingedly mounted within the sub-mounting grooves, an outside of the base seat is configured with a plurality of holes communicating with sub-mounting grooves, the upper end of the support leg is hingedly mounted within the plurality of holes through a pin shaft, a bottom of the main mounting groove is further configured with a sinking groove, the spring is mounted within the sinking groove.

9. An outdoor chair, comprising:

a folding frame and a chair fabric positioned at an upper end of the folding frame, wherein the folding frame includes a base, a plurality of support legs hinged around the base, and a plurality of extendable support rods that are hinged to and can be folded relative to the support legs, the number of the support legs is four, the number of the extendable support rods is four, of which two are long extendable rods, and the other two are short extendable rods, the chair fabric is bucket-shaped, and four corners of the chair fabric are respectively fixedly connected to upper ends of the four extendable rods;

both sides of upper end of the support legs are equipped with toothed portions, and adjacent two support legs are interconnected via the engagement of the toothed portions; a locking module is configured inside the base for simultaneously positioning the support legs that have been opened relative to each other, the locking module includes a pull rod seat mounted in the base and capable of moving up and down, a spring set around the pull rod seat and abutting the base, a plurality of locking blocks hinged inside the base and actively connected with an upper end of the pull rod seat, the pull rod seat is pushed the pull rod seat is pushed up by the spring force to drive one end of the plurality of locking blocks to latch into a locking groove at the upper end of the support leg, forming a fixed support for the support legs that are opened relative to the base; a lower end of the pull rod seat extends out of a lower end face of the base, pulling down the pull rod seat drives the end of the plurality of locking blocks to leave the locking groove at an upper end of the support leg to achieve unlocking.

10. The outdoor chair defined in claim 9, wherein both sides of the plurality of locking blocks are formed with circular protrusions, and are hinged to the base through the circular protrusions, capable of swinging up and down inside the base, the end of the plurality of locking blocks is configured with a hinged groove, and the both sides of the plurality of locking blocks have a bar-shaped sliding hole that penetrates the hinged groove; an outside of an upper end of the pull rod seat is configured with a plurality of hinge portions, a side face of the hinge portion is configured with an axle hole, the plurality of hinge portions are mounted inside the hinged groove on one end of the plurality of locking blocks, the axle hole of the plurality of hinge portions is fitted with a shaft, one end of the shaft goes into the bar-shaped sliding hole, and can slide inside the bar-shaped sliding hole.

11. The outdoor chair defined in claim 9, wherein the pull rod seat comprises a seat body, a pull rod screwed on a lower end of the seat body with adjustable height in relation to the seat body, and a pull ring fitted on the lower end of the pull rod, capable of sliding, the spring is sheathed outside the pull ring, the upper end of the spring abuts the lower end face of the seat body, the lower end of the pull rod extends out of the lower end face of the base, the upper end of the pull ring abuts the lower end face of the base, the lower end of the seat body is formed with a threaded column, the upper end of the pull rod is configured with a threaded slot, the threaded column is screwed inside the threaded slot, the section of the seat body is in the shape of a cross, the outside of the seat body has a hinge portion flexibly connected to the locking block.

12. The outdoor chair defined in claim 11, wherein a lower end face of the base is configured as a spherical groove, an upper end of the pull ring is disposed in the spherical groove and abuts against the spherical groove, the support leg has a storage slot for the retracted extendable support rod.

13. The outdoor chair defined in claim 9, wherein the base includes a base seat and a cover plate covering the base seat, an upper surface of the base seat extends downward to provide a main mounting groove for installing the pull rod seat and a plurality of sub-mounting grooves located outside of the main mounting groove, the pull rod seat is threaded through the main mounting groove, the plurality of locking blocks are hingedly mounted within the sub-mounting grooves, an outside of the base seat is configured with a plurality of holes communicating with the sub-mounting grooves, the upper end of the support leg is hingedly mounted within the plurality of holes through a pin shaft, a bottom of the main mounting groove is further configured with a sinking groove, the spring is mounted within the sinking groove.

14. An outdoor table, which comprises a folding frame and a table fabric disposed at an upper end of the folding frame, wherein the folding frame includes a base, a plurality of support legs hinged around the base, and a plurality of extendable support rods hinged to the support legs, capable of folding in relation to the support legs, the number of the support legs is four, the number of the extendable support rods is four, all of the same length, four corners of the table fabric are respectively connected to and fixed with upper ends of the four extendable support rods through connecting blocks;

both sides of upper end of the support legs are equipped with toothed portions, and adjacent two support legs are interconnected via the engagement of the toothed portions; a locking module is configured inside the base for simultaneously positioning the support legs that have been opened relative to each other, the locking module includes a pull rod seat mounted in the base and capable of moving up and down, a spring set around the pull rod seat and abutting the base, a plurality of locking blocks hinged inside the base and actively connected with an upper end of the pull rod seat, the pull rod seat is pushed the pull rod seat is pushed up by the spring force to drive one end of the plurality of locking blocks to latch into a locking groove at the upper end of the support leg, forming a fixed support for the support legs that are opened relative to the base; a lower end of the pull rod seat extends out of a lower end face of the base, pulling down the pull rod seat drives the end of the plurality of locking blocks to leave the locking groove at an upper end of the support leg to achieve unlocking.

15. The outdoor table defined in claim 14, wherein both sides of the plurality of locking blocks are formed with circular protrusions, and are hinged to the base through the circular protrusions, capable of swinging up and down inside the base, the end of the plurality of locking blocks is configured with a hinged groove, and the both sides of the plurality of locking blocks have a bar-shaped sliding hole that penetrates the hinged groove; an outside of an upper end of the pull rod seat is configured with a plurality of hinge portions, a side face of the hinge portion is configured with an axle hole, the plurality of hinge portions are mounted inside the hinged groove on one end of the plurality of locking blocks, the axle hole of the plurality of hinge portions is fitted with a shaft, one end of the shaft goes into the bar-shaped sliding hole, and can slide inside the bar-shaped sliding hole.

16. The outdoor table defined in claim 14, wherein the pull rod seat comprises a seat body, a pull rod screwed on a lower end of the seat body with adjustable height in relation to the seat body, and a pull ring fitted on the lower end of the pull rod, capable of sliding, the spring is sheathed outside the pull ring, the upper end of the spring abuts the lower end face of the seat body, the lower end of the pull rod extends out of the lower end face of the base, the upper end of the pull ring abuts the lower end face of the base, the lower end of the seat body is formed with a threaded column, the upper end of the pull rod is configured with a threaded slot, the threaded column is screwed inside the threaded slot, the section of the seat body is in the shape of a cross, the outside of the seat body has a hinge portion flexibly connected to the locking block.

17. The outdoor table defined in claim 16, wherein a lower end face of the base is configured as a spherical groove, an upper end of the pull ring is disposed in the spherical groove and abuts against the spherical groove, the support leg has a storage slot for the retracted extendable support rod.

18. The outdoor table defined in claim 14, wherein the base includes a base seat and a cover plate covering the base seat, an upper surface of the base seat extends downward to provide a main mounting groove for installing the pull rod seat and a plurality of sub-mounting grooves located outside of the main mounting groove, the pull rod seat is threaded through the main mounting groove, the plurality of locking blocks are hingedly mounted within the sub-mounting grooves, an outside of the base seat is configured with a plurality of holes communicating with the sub-mounting grooves, the upper end of the support leg is hingedly mounted within the plurality of holes through a pin shaft, a bottom of the main mounting groove is further configured with a sinking groove, the spring is mounted within the sinking groove.

* * * * *